US005447813A

United States Patent [19]

Hagiwara et al.

[11] Patent Number: 5,447,813

[45] Date of Patent: Sep. 5, 1995

[54] TONER FOR DEVELOPING ELECTROSTATIC IMAGE AND IMAGE FORMING METHOD

[75] Inventors: Kazuyoshi Hagiwara; Toshiaki Nakahara; Minoru Shimojo, all of Tokyo; Masami Fujimoto, Kawasaki; Kiyoshi Mizoe, Yokohama, all of Japan

[73] Assignee: Canon Kabushiki Kaisha, Tokyo, Japan

[21] Appl. No.: 352,748

[22] Filed: Dec. 2, 1994

Related U.S. Application Data

[63] Continuation of Ser. No. 77,388, Jun. 17, 1993, abandoned.

[30] Foreign Application Priority Data

Jun. 19, 1992 [JP] Japan ..... 4-184715
May 18, 1993 [JP] Japan ..... 5-116074

[51] Int. Cl.[6] ..... G03G 9/083
[52] U.S. Cl. ..... 430/106.6; 430/137

[58] Field of Search ..... 430/106, 106.6, 110, 430/137

[56] References Cited

U.S. PATENT DOCUMENTS 5,166,027 11/1992 Machida et al. ..... 430/106.6
5,185,229 2/1993 Sato et al. ..... 430/110

*Primary Examiner*—John Goodrow
*Attorney, Agent, or Firm*—Fitzpatrick, Cella, Harper & Scinto

[57] ABSTRACT

A toner for developing an electrostatic image is composed by a binder resin, and a magnetic material and/or a colorant. The binder resin (a) comprises a styrene resin polymerized in the presence of a poly-functional polymerization initiator, (b) provides a molecular weight distribution on a GPC chromatogram showing a maximum (P1) in a molecular weight range of $3.5\times10^3$–$5\times10^4$ and a maximum (P2) or shoulder in a molecular weight range of at least $1\times10^5$, and (c) contains 15 wt. % or less of a resin component in a molecular weight range of at most $3\times10^3$. Further the toner contains at most 100 ppm of styrene and benzaldehyde.

77 Claims, 2 Drawing Sheets

TONER FOR DEVELOPING ELECTROSTATIC IMAGE AND IMAGE FORMING METHOD

This application is a continuation of application Ser. No. 08/077,388 filed Jun. 17, 1993 now abounded.

FIELD OF THE INVENTION AND RELATED ART

The present invention relates to a toner for use in electrophotography, electrostatic recording, etc., and an image forming method using the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is, after being transferred onto a transfer material such as paper, as desired, fixed by various fixing methods to obtain a copy. The fixing methods may include a pressure fixing system of passing between at least two metal rollers, an oven fixing system of passing in a heated atmosphere given by an electric heater, a hot roller fixing system of passing hot rollers as the most popular system at present, and a fixing system using a film as disclosed in U.S. Pat. No. 5,149,941.

In the heat-fixing system using such hot rollers, a sheet carrying a toner image to be fixed (hereinafter called "fixation sheet") is passed, while the surface of a hot roller having a releasability with the toner is caused to contact the toner image surface of the fixation sheet under pressure, to fix the toner image. In this method, as the hot roller and the toner image on the fixation sheet contact each other under a pressure, a very good heat efficiency is attained for melt-fixing the toner image onto the fixation sheet to afford quick fixation, so that the method is very effective in a high-speed electrophotographic copying machine. In this method, however, a toner image in a melted state is caused to contact a hot roller under pressure, so that there is observed a so-called offset phenomenon that a part of the toner image is attached and transferred to the hot roller and then transferred back to the fixation sheet to stain the fixation sheet. It has been regarded as one of the important conditions in the heat-fixing system to prevent the toner from sticking to the hot roller.

In the hot-roller fixing, a relatively long time is required from turning on the power supply for the heater until the hot rollers are heated to a temperature suitable for fixation, thus requiring not a short time (waiting time) for providing a hard copy in office work. Thus, the waiting time causes a time loss and lowers the efficiency of the office work. Various proposals have been made in order to shorten the waiting time and improve the efficiency of fixation in the hot-roller fixing system. Regarding a binder resin in order to improve the fixability of a toner, it is required that the viscosity of the toner on melting is lowered to provide a large adhesion area with the fixation sheet, so that the glass transition temperature (Tg) and molecular weight of the binder resin for the toner are required to be lowered.

If the Tg and molecular weight of the binder resin are simply lowered, the above-mentioned offset is liable to occur. In this way, the low-temperature fixability and anti-offset characteristic are generally contradictory, so that it is not easy to develop a toner satisfying these requirements simultaneously.

As a binder resin satisfying the above requirements, Japanese Patent Publication (JP-B) 63-32182 and JP-B 63-32382 have proposed a binder resin having two peaks in a molecular weight distribution as measured by gel permeation chromatography (GPC). The binder resin has been designed to improve the fixability by its low-molecular weight component and improve the anti-offset characteristic by its high-molecular weight component, thus showing excellent performances. However, further lowering in molecular weight causes a decrease in developing performance of the resultant toner and an increase in volatile matter content within the toner. Accordingly, a toner having a further increased fixability and suitably used in the hot-roller fixing system while avoiding the above difficulty is desired.

In recent years, the recording method using electrophotography has extended its applicability including office use and private or home use. For such use, if the toner retains a large residual monomer or solvent content, unpleasant odor is evolved at the time of image formation or fixing, so that a toner with a reduced residual monomer or solvent content is desired.

In recent years, a contact charging means has been developed in place of a corona charging system to be used in electrophotographic apparatus so as to prevent occurrence of ozone under high voltage application for forming electrostatic images on a photosensitive member surface. In an electrophotographic apparatus using such contact charging means, the occurrence of ozone is almost prevented so that it becomes possible to omit an ozone filter. In this case of using no ozone filter, however, the problem of odor evolved from a developer is liable to occur noticeably.

In order to reduce the residual monomer content in a toner, several methods may be employed, inclusive of the use of an increased amount of polymerization initiator for producing a binder resin, a prolonged period of distillation for removing the solvent under a reduced pressure after such such polymerization, or a high-temperature kneading under a reduced pressure for producing a toner. These methods for reducing the residual monomer content are accompanied by several difficulties. For example, a simple increase in polymerization initiator amount causes difficulties in molecular weight distribution of the resultant polymer, such as an increase in low-molecular weight component and broadening of peaks in the molecular weight distribution and can result in poor developing performances. The prolonged period of distillation under a reduced pressure for removing the solvent after the polymerization is accompanied by difficulties, such as a long-time occupation of the production apparatus increased energy consumption requiring a large heat energy and a lowering in molecular weight of the resin due to depolymerization (decomposition of the polymer). The high-temperature kneading under a reduced pressure for production of a toner is liable to cause a degradation of the other components of the toner, such as wax, thus resulting in, e.g., poor dispersibility of the components.

A corona discharger has been conventionally used as a charging means in electrophotographic apparatus, etc. As is briefly mentioned hereinbefore, however, the corona discharger is accompanied by difficulties, such as necessity of applying a high voltage and occurrence of a large quantity of ozone.

Accordingly, in recent years, it has been considered to use a contact charging means instead of a corona discharger. More specifically, such contact charging means may be constituted by an electroconductive roller, as a charging member, which is supplied with a voltage and is caused to contact a photosensitive-member as a member to be charged, thereby charging the photosensitive member surface to a prescribed potential. By using such a contact charging means, it is possible to use a lower voltage and reduce the amount of ozone generation in comparison with a corona discharger.

In an image forming apparatus using a step of electrostatically transferring a toner image formed on a latent image-bearing member (photosensitive member) to a transfer-receiving medium in a sheet form, such as paper, it has been proposed to use a transfer device in the form of a roller, etc., supplied with a bias voltage to be pressed against a latent image-bearing member in the form of, e.g., a rotatable cylinder or an endless belt so as to pass a transfer-receiving medium therebetween and transfer a toner image on the latent image-bearing member onto the transfer-receiving medium as disclosed, e.g., in Japanese Laid-Open Patent Application (JP-A) 59-46664.

In contrast with transfer means utilizing corona discharge, such a transfer device can enlarge an area of contact of the transfer-receiving medium onto the latent image-bearing member by regulating the pressure of the transfer roller exerted against the latent image-bearing member, thereby positively supporting the transfer-receiving medium under pressure at the transfer position. As a result, it is possible to reduce a synchronization failure due to a conveyer for transfer-receiving medium and minimize transfer deviation due to loop or curl of the transfer-receiving medium. Accordingly, it is possible to easily comply with the requirements of shorter conveying passage for transfer-receiving media and a smaller diameter of latent-image bearing member as required in compactization of such image forming apparatus in recent years.

However, in the case of using contact charging means as described above, there arises a problem of charging failure unless a sufficient contact with the member to be charged is ensured. There is also a problem that, if a developer component remains on the surface of a photosensitive member at the abutting position exerting a certain pressure by the charging member against the photosensitive member, the developer component remaining on the surfaces of the charging member and the photosensitive member are stuck thereat, thus adversely affecting the latent image formation and developing.

In the apparatus adopting abutting transfer disclosed in JP-A 59-46664, it is necessary to apply a certain pressure against the transfer device as a transfer current is supplied at the abutting position. When such an abutting pressure is applied, the pressure is also applied to the toner image on the latent image-bearing member, thus being liable to cause agglomeration.

Further, in case where the surface of the latent image-bearing member is composed of a resin, the toner agglomerate contacting the latent image-bearing member is also liable to stick to the abutting surfaces of the latent image bearing member and the transfer device.

When such phenomena occur, various difficulties can be encountered, such as a lack in a latent image formed and a transfer dropout, leading to formation of defective toner images.

SUMMARY OF THE INVENTION

A generic object of the present invention is to provide a toner for developing electrostatic images and an image forming method having solved the above-mentioned problems.

A more specific object of the present invention is to provide a toner for developing electrostatic images showing excellent low-temperature fixability and anti-offset characteristic as well as excellent developing performance, which toner contains little volatile matter such as a residual monomer and is less liable to evolve an odor.

Another object of the present invention is to provide an image forming method adopting a hot-roller fixing system capable of complying with shortening of the waiting time and higher speed of electrophotographic process.

Another object of the present invention is to provide a toner for developing electrostatic images containing little volatile matter content, such as residual monomer, decomposition product, by-products, and residual solvent and having little odor.

A further object of the present invention is to provide an image forming method accompanied with suppressed odor, such as ozone odor or toner odor.

A further object of the present invention is to provide a toner for developing electrostatic images suitable for use in an image forming method adopting contact charging means and transfer means including an abutting transfer roller, which toner is free from sticking onto the surfaces of the charging means and the photosensitive member and can provide toner images of excellent image qualities continually for a long period.

According to the present invention, there is provided a toner for developing an electrostatic image, comprising a binder resin, and a magnetic material and/or a colorant, wherein the binder resin (a) comprises a styrene resin polymerized in the presence of a poly-functional polymerization initiator, (b) provides a molecular weight distribution on a GPC chromatogram showing a maximum (P1) in a molecular weight range of $3.5\times10^3-5\times10^4$ and a maximum (P2) or shoulder in a molecular weight range of at least $1\times10^5$ and (c) contains 15 wt. % or less of a resin component in a molecular weight range of at most $3\times10^3$ and the toner contains at most 100 ppm of styrene and benzaldehyde.

According to another aspect of the present invention, there is provided an image forming method, comprising:

charging an electrostatic latent image-bearing member by abutting a charging member supplied with a voltage to the electrostatic latent image-bearing member;

exposing the charged electrostatic image-bearing member to light to form an electrostatic latent image thereon;

developing the electrostatic latent image with the above-mentioned toner to form a toner image thereon;

transferring the toner image onto a transfer-receiving material while pressing the transfer-receiving material by a transfer member supplied with a voltage against the toner image, and fixing the toner image transferred to the transfer-receiving material onto the transfer-receiving material by a hot roller having a core metal thickness of at most 1 mm.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
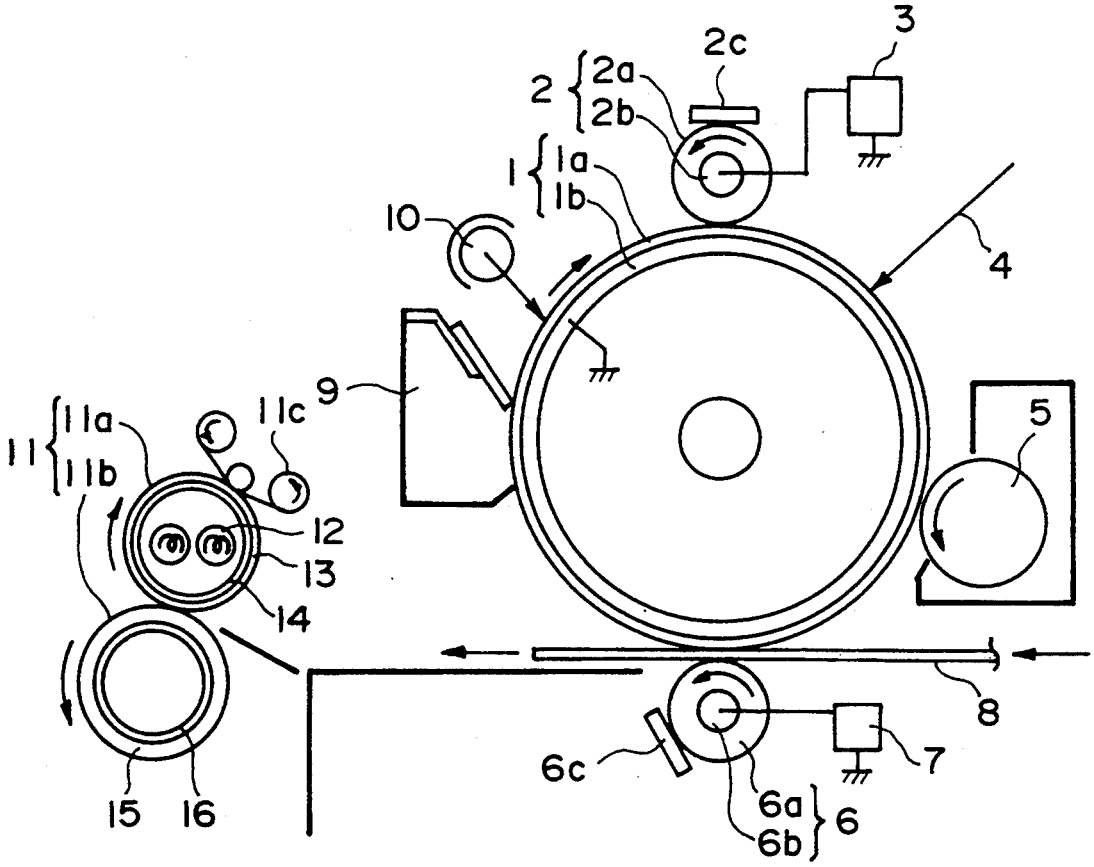
FIG. 1 is a schematic illustration of an image forming apparatus for practicing an embodiment of the image forming method according to the present invention.

The binder resin in the toner according to the present invention is characterized by showing a molecular weight distribution on a chromatogram of GPC (gel permeation chromatography) showing a peak (maximum) in a molecular weight region of $3.5\times10^3-5\times10^4$ and a peak (maximum) or shoulder in a molecular weight region of at least $1\times10^5$. Herein, the shoulder means a point on a GPC chromatogram which provides an extreme point on a curve given by differentiating the GPC chromatogram.

The maximum in the molecular weight region of $3.5\times10^3-5\times10^4$ provides a toner showing a good fixability and a good pulverizability in a pulverization step for providing the toner, and the maximum or shoulder in the molecular weight region of at least $1\times10^5$ provides a good anti-offset characteristic.

A resin component in the molecular weight range of at least $1\times10^5$ and providing a maximum or shoulder in the range provides a better anti-offset characteristic if it is contained in a larger proportion, but an excess thereof can hinder the fixing performance. In the molecular weight distribution according to GPC, the resin component in the molecular weight range of at least $1\times10^5$ may preferably be 5–50 wt. %, more preferably 10–50 wt. %. Below 5 wt. %, good anti-offset characteristic cannot be achieved in some cases, and it becomes difficult to prevent toner flowout through a cleaning member provided to a fixing device. On the other hand, in excess of 50 wt. %, the liability of impairing the fixability is pronounced. In order to enhance the anti-offset characteristic while retaining the fixability, it is preferred to shift the maximum or shoulder in the molecular weight distribution toward a higher-molecular weight side and provide the resin component with a higher molecular weight.

In order to obtain such a high molecular weight resin component, it is preferred to effect polymerization in the presence of a polyfunctional polymerization initiator. The polyfunctional polymerization initiator may preferably have at least three functional groups generating radicals, more preferably four or more functional groups. According to our study, a very strong internal friction acts during melt-kneading for toner production, and a large shearing force is applied to the polymer, thus causing severance of the polymer components to provide a tendency of lowering the molecular weight of the high molecular weight component as a whole. As a result, the binder resin in the toner is liable to have a molecular weight distribution which is lower as a whole than that of the binder resin as a starting material of the toner, so that the molecular weight distribution of the binder resin as the toner material does not completely correspond to the anti-offset characteristic of the resultant toner.

According to our study, if the number of radical-generating functional groups in the poly-functional polymerization initiator is increased, the molecular weight distribution of the binder resin as the toner material can be shifted to a higher molecular weight side and the molecular severance of the high-molecular weight component during melt-kneading for toner production cannot be readily caused, so that a resin component having a molecular weight of at most $3\times10^3$ cannot be readily formed. As a result, the resultant toner is provided with a better anti-offset characteristic than a toner obtained by using a starting binder resin produced by using a polymerization initiator having less functional groups. It is also possible to reduce the residual monomer content in the starting binder resin by using a polyfunctional polymerization initiator having a larger number of functional groups.

The presence of a maximum in the molecular weight range of $3.5\times10^3$–$5\times10^4$ in the GPC molecular weight of $3.5\times10^3$–$5\times10^4$ in the GPC molecular weight distribution is preferred in view of the toner fixability and pulverizability in the pulverization step for toner production. The position of the maximum at a lower molecular weight side in the molecular weight distribution favors a lower temperature fixation. In view of anti-blocking characteristic, it is preferred that the maximum is present in the molecular weight region of $5\times10^35\times10^4$. A low-molecular weight component having a molecular weight of below $5\times10^3$ is liable to adversely affect the developing performance, etc. If the maximum is present at a molecular weight below $5\times10^3$ and the amount of such a low-molecular weight component is increased, the anti-offset characteristic is adversely affected, and several difficulties are liable to be encountered, such as occurrence of blocking, occurrence of toner sticking onto the drum surface, and occurrence of melt-sticking onto the inside of toner production apparatus. Further, the toner can stick to a toner-carrying member (developing sleeve) or triboelectricity-imparting member (coating blade or coating roller) to lower the triboelectricity-imparting ability, thus impairing the developing performance. If the position of the lower molecular weight side maximum is shifted beyond a molecular weight of $5\times10^4$ a poor fixability results.

The component having a molecular weight of at most $5\times10^4$ favors the fixability and may preferably occupy 30–95 wt. %, further preferably 40–90 wt. %, in the molecular weight distribution. Below 30 wt. %, it is difficult to obtain good fixability, and poor pulverizability is liable to result in the pulverization step for toner production. On the other hand, in excess of 95 wt. %, it becomes difficult to obtain a sufficient anti-offset characteristic.

The content of a low-molecular weight resin component providing a maximum in the molecular weight range of $3.5\times10^3$–$5\times10^4$ is increased in order to provide a good low-temperature fixability. Accordingly, the residual monomer content and residual by-products at the time of synthesizing the resin component greatly affect the residual monomer content and by-products in the total resin.

If the reduction in residual monomer content in the toner is aimed at simply by increasing the polymerization initiator amount and controlling the production conditions so as to reduce the residual monomer content in the low-molecular weight resin component, the molecular weight distribution of the low-molecular weight resin component becomes broad and the content of a resin component having a molecular weight of at most $3\times10^3$ corresponding to the foot of the low-molecular weight component peak is increased, thus being liable to result in a low toner chargeability and a lowering in image density.

The resin component having a molecular weight of at most $3\times10^3$ may preferably be at most 15%, more preferably at most 13%, further preferably at most 10%.

It has been discovered preferable that the low-molecular weight resin component providing a maximum in the molecular weight range of $3.5\times10^3 5\times10^4$ is prepared by polymerization in the presence of at least two different polymerization initiators including a polymerization initiator A having a longer half-life and a polymerization initiator B having a shorter half-life and under a condition providing half-lives $\tau_A$ and $\tau_B$, respectively, of the polymerization initiators at the polymerization temperature satisfying a ratio $\tau_A/\tau_B$ of at least 1.5 and is used to constitute a toner for developing electrostatic images for accomplishing the above objects.

More specifically, according to a result of our extensive study, when the low-molecular weight resin component providing a maximum in the molecular weight region of $3.5\times10^3$–$5\times10^4$ is produced by polymerization in the presence of at least two different polymerization initiators including the polymerization initiators A and B described above, it is easy to provide a peak in the molecular weight distribution showing a sharp low-molecular weight side than the maximum and thus providing a content of at most 15% of the component having a molecular weight of at most $3\times10^3$ As a result it is possible to provide a toner with sufficient developing performance and fixing characteristic as well as a reduced residual monomer content and less odor.

It is further preferred that the polymerization temperature for producing the low-molecular weight resin component is in the range of 75°–145° C., and the polymerization initiator B having a shorter half-life shows a half-life $\tau_B$ at the polymerization temperature of at least 0.1 hour, further preferably 0.5–10 hours.

The ratio $\tau_A/\tau_B$ between the half-lives $\tau_A$ and $\tau_B$ of the polymerization initiator A having a longer half-life and the polymerization initiator B having a shorter half-life may preferably be in the range of 2 to $5\times10^3$.

It is further preferred to adopt such a combination that the polymerization temperature for producing the low-molecular weight resin component is in the range of 75°–145° C. and, at the polymerization temperature, the polymerization initiator B having a shorter half-life shows a half-life $\tau_B$ of 0.5–3 hours and the polymerization initiator A having a longer half-life shows a half-life $\tau_A$ of 2 to 60 hours providing a ratio $\tau_A/\tau_B$ of 2 to $5\times10^2$.

The amounts of the polymerization initiators A and B and the ratio therebetween may be determined in view of the molecular weight distribution of the resultant low-molecular weight resin component, the kinds of monomers therefor and the production conditions. The total amount of the polymerization initiators A and B may preferably be 0.1–5 wt. parts per 100 wt. parts of the polymerizable monomer(s) for synthesizing the low-molecular weight resin component providing a maximum in the molecular weight range of $3.5\times10^3$–$5\times10^4$. The ratio of the polymerization initiator A/the polymerization initiator B may be in the range of 0.01–100, preferably 0.1–10.

It is preferred to use a polymerizable vinyl monomer as the polymerizable monomer for providing the low-molecular weight resin component (i.e., a low-molecular weight vinyl resin). The thus-produced vinyl resin may preferably comprise a styrene resin, preferred examples of which may include styrene homopolymer, styrene-acrylate copolymer, and styrene-methacrylate copolymer.

By using the above-described method, it is possible to reduce the residual monomer content in the toner. According to the present invention, the content of styrene monomer and benzaldehyde is required to be at most 100 ppm in the toner. It is preferred that the benzaldehyde content is at most 10 ppm as it evolves a peculiar and strong odor. The residual styrene monomer content may preferably be at most 50 ppm. In case where an acrylic monomer ((meth)acrylate or (meth)acrylic acid) is used as a comonomer, the residual acrylic monomer content may preferably be at most 30 ppm.

By reducing the residual monomer and by-produced benzaldehyde contents, not only the occurrence of odor is suppressed during a copying operation but also the so-called filming or melt-sticking is also suppressed as the sticking of toner particles onto the photosensitive member becomes difficult. The filming or melt-sticking has been liable to occur particularly in an apparatus including a contact charging and/or a contact transfer device, but the phenomenon can be suppressed by reducing the residual monomer and benzaldehyde contents in the toner.

We have also found that the reduced residual monomer content leads to reduction of toner particles and silica powder attached to a transfer roller and reduction of free silica accumulated on a stay in a developing device.

The reason for the above phenomena has not been fully clarified as yet. However, it may be considered that the residual monomer contributes to isolation of the silica powder from the toner particles, and the reduction of the residual monomer has led to the isolation of the silica powder.

The determination of the residual monomer and benzaldehyde content may be performed by gas chromatography, e.g., in the following manner.

2.55 mg of N,N-dimethylformamide (DMF) is used as the internal standard and 100 ml of acetone is added thereto to form a solvent containing the internal standard. Then, 400 mg of a toner sample is dissolved in a portion of the solvent to form a 10 ml solution. The solution is then subjected to 30 min. of ultrasonic vibration, followed by 1 hour of standing and filtration through a 0.5 μm-filter. Then, 4 μl of the sample solution is injected to a gas chromatograph.

The conditions for the gas chromatography may include the following.

Capillary column (30 m×0.249 mm, internal surface thereof being coated with a 0.25 μm-thick layer of a separating agent (DBWAX, mfd. by J & W Scientific, U.S.A.))

Detector: FID (flame ionization detector), nitrogen pressure: 0.45 kg/cm$^2$.

Injection temp.: 200° C., Detector temp.: 200° C. The column temperature is raised from 50° C. at a rate of 5° C./min. for 30 min.

Preparation of calibration curve.

Standard samples obtained by adding the objective monomer in varying amounts into the DMF-acetone solution in the same amount as the sample solution are similarly subjected to gas chromatography to determine the weight ratio/areal ratio between the monomer and the internal standard DMF with respect to the standard samples containing varying amounts of the objective monomer.

Alternatively, the measurement by gas chromatography may be performed in a similar manner as above by using toluene as the internal standard and tetra-hydrofuran as the solvent.

The polymerization initiator used in the present invention may be an ordinary oil-soluble initiator, examples of which may include: peroxide initiators, such as acetylcyclohexylsulfonyl peroxide, isobutyryl peroxide, diisopropyl peroxydicarbonate, 2-ethylhexyl peroxydicarbonate, 2,4-dichlorobenzoyl peroxide, t-butyl peroxypivarate, 3,5,5-trimethylhexanoyl peroxide, octanoyl peroxide, octanoyl peroxide, decanoyl peroxide, lauroyl peroxide, stearoyl peroxide, propionyl peroxide, succinic acid peroxide, acetyl peroxide, t-butyl peroxy-2-ethylhexanoate, benzoyl peroxide, parachlorobezoyl peroxide, t-butyl peroxyisobutyrate, t-butyl peroxymaleic acid, t-butyl peroxylaurate, cyclohexanone peroxide, t-butyl-peroxyisopropylcarbonate, 2,5-dimethyl-2,5-dibenzoyl-peroxyhexane, t-butyl peroxyacetate, t-butyl peroxybenzoate, diisobutyl diperoxyphthalate, methyl ethyl ketone peroxide, dicumyl peroxide, 2,5-dimethyl-2,5-di-t-butyl-peroxyhexane, t-butyl cumyl peroxide, t-butyl hydroperoxide, di-t-butyl peroxide, 2,5-dimethyl-2,5-di-t-butylperoxyhexane, diisopropylbenzene hydroperoxide, paramenthane hydroperoxide, pinane hydroperoxide, 2,5-dimethylhexane-2,5-dihydroperoxide, and cumeme hydroperoxide; and azo-type initiators, such as 2,2'-azobisisobutyronitrile, 1,1'-azobiscyclohexane-1-carbonitrile, 2,2'-azobis-4-methoxy-2,4-dimethyl-valeronitrile, and 2,2'-azobis-2,4-dimethylvaleronitrile. These initiators may be used singly, or in combination of two or more species, or in combination with a poly-functional radical polymerization initiator, as desired.

In order to produce a high-molecular weight styrene resin component which is preferably used in the present invention, it is preferred to use a poly-functional polymerization initiator, by which it is possible to produce a higher molecular weight styrene resin component providing a satisfactory anti-offset characteristic.

Examples of poly-functional polymerization initiator usable in the present invention may include: di-functional radical polymerization initiators, such as 1,1-bis(t-butylperoxy)-3,3,5-trimethylcyclohexane, 1,1-bis(t-butylperoxy)cyclohexane, 1,4-bis(t-butyl-peroxycarbonyl)cyclohexane, 2,2-bis(t-butylperoxy)octane, n-butyl-4,4-bis(t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(t-butylperoxy)hexane, 2,5-dimethyl-2,5-di(-benzoylperoxy)hexane, di-t-butyl-diperoxyisophthalate, 2,2-bis(4,4-di-t-butylperoxycyclohexyl)propane, di-t-butyl peroxy-α-methylsuccinate, di-t-butyl peroxydimethylglutarate, di-t-butyl peroxyhexahydroterephthalate, di-t-butyl peroxyazelate, 2,5-dimethyl-2,5-di(t-butylperoxy)hexane, diethylene glycol-bis(t-butylperoxycarbonate), and di-t-butyl peroxytrimethyladipate; tri-functional radical polymerization initiators, such as tris(t-butylperoxy)triazine, and vinyl-tris(t-butylperoxy)silane; and other poly-functional radical polymerization initiators, such as 2,2-bis(4,4-di-t-butylperoxycyclohexyl)propane, copolymerizates of t-butylperoxyallylcarbonate (e.g., "Hyper B" and "Hyper G" series available from Nippon Yushi K.K.), and copolymerizates of t-butylperoxymaleic acid.

These poly-functional polymerization initiators may be used singly or in combination of two or more species, or in combination with a mono-functional polymerization initiator, as desired. The poly-functional polymerization initiator may be used in a proportion of 0.01–5 wt. %, preferably 0.05–3 wt. %, of the monomer(s) giving a high-molecular weight styrene resin providing a maximum or shoulder in the molecular weight region of at least $1\times10^5$.

The molecular weight (distribution) of a binder resin may be measured based on a chromatogram obtained by GPC (gel permeation chromatography) in the following manner.

In the GPC apparatus, a column is stabilized in a heat chamber at 40° C., tetrahydrofuran (THF) solvent is caused to flow through the column at that temperature at a rate of 1 ml/min., and 50–200 μl of a GPC sample solution adjusted at a concentration of 0.05–0.1 wt. % is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be available from, e.g., Pressure Chemical Co. or Toso K.K. It is appropriate to use at least 10 standard polystyrene samples inclusive of those having molecular weights of, e.g., $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The detector may be an RI (refractive index) detector. For accurate measurement, it is appropriate to constitute the column as a combination of several commercially available polystyrene gel columns in order to effect accurate measurement in the molecular weight range of $10^3$–$4\times10^6$. A preferred example thereof may be a combination of μ-styragel 500, $10^3$, $10^4$ and $10^5$ available from Waters Co; a combination of Shodex KF-801, 802, 803, 804 and 805 available from Showa Denko K.K.; or a combination of TSK gel G1000H, G2000H, G2500H, G3000H, G4000H, G5000H, G6000H, G7000H, and GMH available from Toso K.K.

In the present invention, the weight percentage of each resin component in the total binder resin may for example be obtained in the following manner.

The weight percentage of the resin component in the molecular weight range of at most $3\times10^3$ is measured as an areal percentage of a component in a molecular weight range of $4\times10^2$–$3\times10^3$ with respect to the total area of component in a molecular weight range of $4\times10^2$ or larger, respectively based on the GPC chromatogram of the binder resin (THF-soluble). In case where any THF-insoluble is present, the weight percentage of the respective components measured with respect to the THF-soluble within the toner binder resin is corrected by taking the THF-insoluble into consideration. For example, the above-obtained areal percentage of the component in the molecular weight range of $4\times10^2$–$3\times10^3$ is multiplied by the THF-soluble percentage for correction in order to obtain the weight percentage of the component in the total binder resin.

Figure 2:
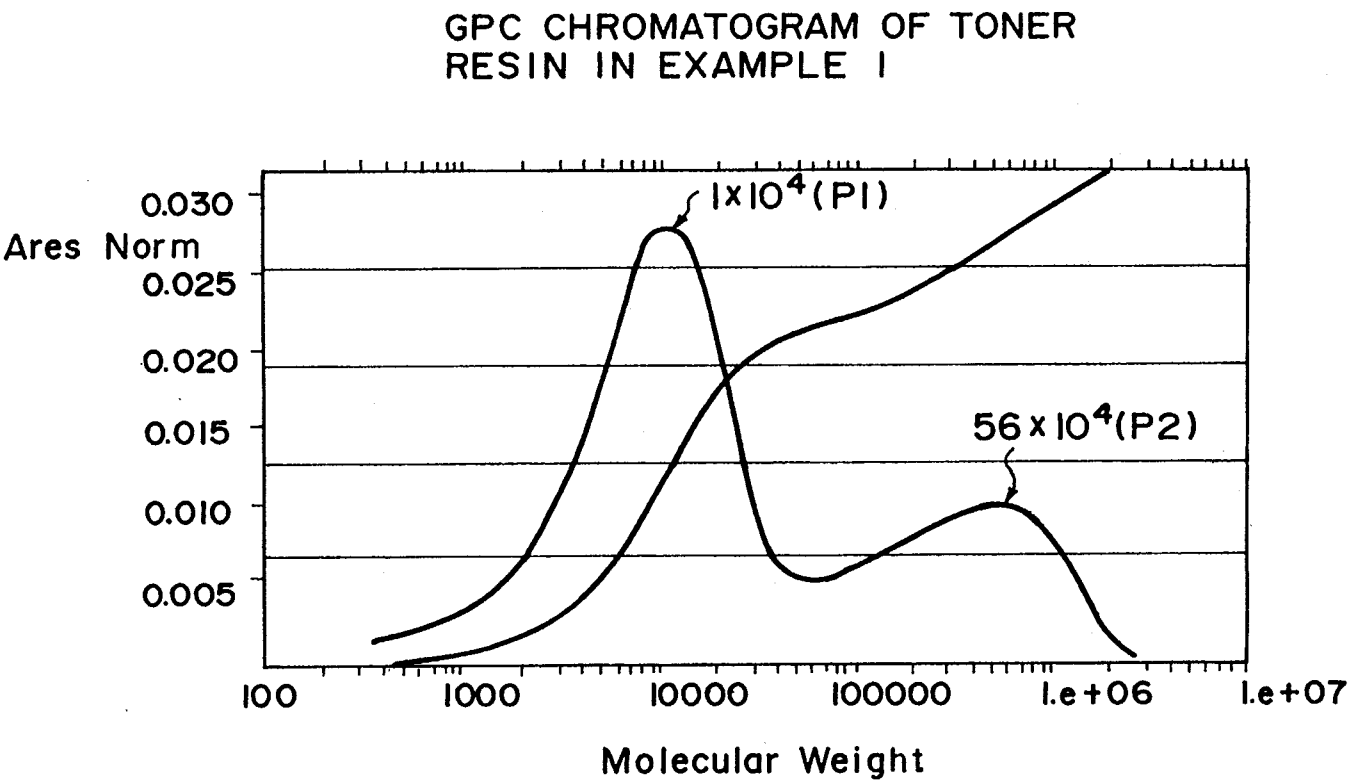
FIG. 2 is a GPC chromatogram of a toner binder resin used in Example 1 of the present invention.

An example of such a GPC chromatogram is shown in FIG. 2.

The binder resin of the present invention may preferably comprise a styrene polymer or a styrene copolymer. Herein, the styrene polymer means a polymer (homopolymer or copolymer) of only one or more of styrene-type monomers, i.e., styrene and its derivatives, and the styrene copolymer means a copolymer of a styrene-type monomer and another comonomer.

More specifically, examples of the styrene-type monomer may include: styrene; and styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tertbutylstyrene, p-n-hexylstyrene, p-n-octylstyrene, p-n-nonylstyrene, p-n-decylstyrene, and p-n-dodecylstyrene.

Examples of the comonomer for providing the styrene copolymer may include ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacryronitrile, and acrylamide; esters of $\alpha,\beta$-unsaturated acids and diesters of dibasic acids. These comonomers may be used singly or in combination of two or more species.

The binder resin used in the present invention can include a crosslinking structure, as desired, obtained by using a crosslinking monomer, examples of which are enumerated hereinbelow.

Aromatic divinyl compounds, such as divinylbenzene and divinylnaphthalene; diacrylate compounds connected with an alkyl chain, such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and compounds obtained by substituting methacrylate groups for the acrylate groups in the above compounds; diacrylate compounds connected with an alkyl chain including an ether bond, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate and compounds obtained by substituting methacrylate groups for the acrylate groups in the above compounds; diacrylate compounds connected with a chain including an aromatic group and an ether bond, such as polyoxyethylene(2)-2,2-bis(4-hydroxyphenyl)propanediacrylate, polyoxyethylene(4)-2,2-bis(4-hydroxyphenyl)propanediacrylate, and compounds obtained by substituting methacrylate groups for the acrylate groups in the above compounds; and polyester-type diacrylate compounds, such as one known by a trade name of MANDA (available from Nihon Kayaku K.K.). Polyfunctional crosslinking agents, such as pentaerythritol triacrylate, trimethylethane triacrylate, tetramethylolmethane tetracrylate, oligoester acrylate, and compounds obtained by substituting methacrylate groups for the acrylate groups in the above compounds; triallyl cyanurate and triallyl trimellitate.

These crosslinking agents may preferably be used in a proportion of about 0.01–5 wt. parts, particularly about 0.03–3 wt. parts, per 100 wt. parts of the other vinyl monomer components.

In the present invention, the high-molecular weight styrene resin polymerized in the presence of a polyfunctional polymerization initiator and the low-molecular weight resin component providing a maximum in the molecular weight range of $3.5\times10^3$–$5\times10^4$ may be blended in a weight ratio of 10–70:90–30, preferably 20–60:80–40.

The above-described binder resin can be blended with another resinous compound as described below in an amount less than the binder resin within an extent not adversely affecting the effect of the present invention.

Examples of such another resinous compound may include: silicone resin, polyester, polyurethane, epoxy resin, polyvinyl butyral, rosin, modified rosin, terpene resin, phenolic resin, aliphatic or alicyclic hydrocarbon resin such as low-molecular polyethylene or low-molecular weight polypropylene, aromatic petroleum resin, chlorinated paraffin, paraffin wax, etc.

The binder resin used in the present invention may be obtained through polymerization, such as bulk polymerization, solution polymerization, suspension polymerization, or emulsion polymerization.

The toner for developing electrostatic images according to the present invention can further contain a charge control agent, as desired, for further stabilizing the chargeability.

Charge control agents known in the art at present may include the following.

Examples of the negative charge control agent may include: organic metal complexes and chelate compounds inclusive of monoazo metal complexes acetylacetone metal complexes, and organometal complexes of aromatic hydroxycarboxylic acids and aromatic dicarboxylic acids. Other examples may include: aromatic hydroxycarboxylic acids, aromatic mono- and poly-carboxylic acids, and their metal salts, arthydrides and esters, and phenol derivatives, such as bisphenols.

Examples of the positive charge control agents may include: nigrosine and modified products thereof with aliphatic acid metal salts, etc,, onium salts inclusive of quarternary ammonium salts, such as tributylbenzyl ammonium 1-hydroxy-4-naphtholsulfonate and tetrabutylammonium tetrafluoroborate, and their homologous inclusive of phosphonium salts, and lake pigments thereof; triphenylmethane dyes and lake pigments thereof (the laking agents including, e.g., phosphotungstic acid, phosphomolybdic acid, phosphotungstic-molybdic acid, tannic acid, lauric acid, gallic acid, ferricyanates, and ferrocyanates); higher aliphatic acid metal salts; acetylacetone metal complexes; diorganotin oxides, such as dibutyltin oxide, dioctyltin oxide and dicyclohexyltin oxide; and diorganotin borates, such as dibutyltin borate, dioctyltin borate and dicyclohexyltin borate. These may be used singly or in mixture of two or more species. Among these, nigrosine compounds and organic quarternary ammonium salts are particularly preferred.

It is preferred to use the toner according to the present invention together with silica fine powder blended therewith in order to improve the charge stability, developing characteristic and fluidity.

The silica fine powder used in the present invention provides good results if it has a specific surface area of 30 $m^2/g$ or larger, preferably 50–400 $m^2/g$, as measured by nitrogen adsorption according to the BET method. The silica fine powder may be added in a proportion of 0.01–8 wt. parts, preferably 0.1–5 wt. parts, per 100 wt. parts of the toner.

For the purpose of being provided with hydrophobicity and/or controlled chargeability, the silica fine powder may well have been treated with a treating agent, such as silicone varnish, modified silicone varnish, silicone oil, modified silicone oil, silane coupling agent, silane coupling agent having functional group or other organic silicon compounds. It is also preferred to use two or more treating agents in combination.

Other additives may be added as desired, inclusive of: a lubricant, such as polytetrafluoroethylene, zinc stearate or polyvinylidene fluoride, of which polyvinylidene fluoride is preferred; an abrasive, such as cerium oxide, silicon carbide or strontium titanate, of which strontium titanate is preferred; a flowability-imparting agent, such as titanium oxide, aluminum oxide, hydrophobic titanium oxide or hydrophobic aluminum oxide, of which a hydrophobic one is preferred; an anti-caking agent, and an electroconductivity-imparting agent, such as carbon black, zinc oxide, antimony oxide, or tin oxide. It is also possible to use a small amount of white or black fine particles having a polarity opposite to that of the toner particles as a development characteristic improver.

It is also a preferred embodiment of the present invention to incorporate within the toner a waxy substance, such as low-molecular weight polyethylene, low-molecular weight polypropylene, microcrystalline wax, carnauba wax, sasol wax, or paraffin wax in an amount of 0.5–10 wt. parts per 100 wt. parts of the binder resin.

The toner according to the present invention can be mixed with carrier powder to be used as a two-component developer. In this instance, the toner and the carrier powder may be mixed with each other so as to provide a toner concentration of 0.1–50 wt. %, preferably 0.5–10 wt. %, further preferably 3–10 wt. %.

The carrier used for this purpose may be a known one, examples of which may include: powder having magnetism, such as iron powder, ferrite powder, and nickel powder and carriers obtained by coating these powders with a resin, such as a fluorine-containing resin, a vinyl resin or a silicone resin.

The toner according to the present invention can be constituted as a magnetic toner containing a magnetic material in its particles. In this case, the magnetic material also functions as a colorant. Examples of the magnetic material may include: iron oxide, such as magnetite, hematite, and ferrite; metals, such as iron, cobalt and nickel, and alloys of these metals with other metals, such as aluminum, cobalt, copper, lead, magnesium, tin, zinc, antimony, beryllium, bismuth, cadmium, calcium, manganese, selenium, titanium, tungsten and vanadium; and mixtures of these materials.

The magnetic material may have an average particle size of 0.1–2 μm, preferably 0.1–0.5 μm. The magnetic material may preferably show magnetic properties under application of 10 kilo-Oersted, inclusive of: a coercive force of 20–150 Oersted, a saturation magnetization of 50–200 emu/g, and a residual magnetization of 2–20 emu/g. The magnetic material may be contained in the toner in a proportion of about 20–200 wt. parts, preferably 40–150 wt. parts, per 100 wt. parts of the resin component.

The toner according to the present invention can contain a colorant which may be an appropriate pigment or dye. Examples of the pigment may include: carbon black, aniline black, acetylene black, Naphthol Yellow, Hansa Yellow, Rhodamine Lake, Alizarin Lake, red iron oxide, Phthalocyanine Blue, and Indanthrene Blue. These pigments are used in an amount sufficient to provide a required optical density of the fixed images, and may be added in a proportion of 0.1–20 wt. parts, preferably 2–10 wt. parts, per 100 wt. parts of the binder resin. Examples of the dye may include: azo dyes, anthraquinone dyes, xanthene dyes, and methine dyes, which may be added in a proportion of 0.1–20 wt. parts, preferably 1–10 wt. parts, per 100 wt. parts of the binder resin.

The toner according to the present invention may be prepared through a process including: sufficiently blending the binder resin, the wax, a metal salt or metal complex, a colorant, such as pigment, dye and/or a magnetic material, and an optional charge control agent and other additives, as desired, by means of a blender such as a Henschel mixer or a ball mill, melting and kneading the blend by means of hot kneading means, such as hot rollers, a kneader or an extruder to cause melting of the resinous materials and disperse or dissolve the magnetic material, pigment or dye therein, and cooling and solidifying the kneaded product, followed by pulverization and classification.

The thus obtained toner may be further blended with other external additives, as desired, sufficiently by means of a mixer such as a Henschel mixer to provide a toner for developing electrostatic images.

An embodiment of the image forming method according to the present invention will be described with reference to FIG. 1 illustrating an apparatus therefor.

The apparatus includes a rotating drum-type electrostatic image-bearing member (hereinafter referred to as "photosensitive member") 1, which basically comprises an electroconductive substrate 1*b* of, e.g., aluminum and a photoconductive layer 1*a* disposed on the outer surface thereof and rotates at a prescribed peripheral speed (process speed) in a clockwise direction as illustrated on the drawing.

In this embodiment, the photosensitive member comprises an organic photoconductor (OPC) and is constituted as a photosensitive drum having an outer diameter of 30 mm.

The apparatus also includes a charging roller 2 which comprises a metal core 2*b* and an electroconductive elastomer layer 2*a* disposed on the outer surface thereof. The charging roller 2 is pressed against the photosensitive member 1 at a certain pressing force and rotates following the rotation of the photosensitive member 1. The charging roller 2 is supplied with a voltage from a charging bias supply 3 and thereby changes the surface of the photosensitive member 1 to a prescribed polarity and potential. Then, the photosensitive member is illuminated with imagewise exposure light 4 to form an electrostatic latent image thereon, which is then developed into a toner image by a developing device 5.

In this embodiment, the charging roller 2 has an outer diameter of 16 mm, and the electroconductive rubber 2*a* comprises styrene-butadiene rubber (SBR) surfaced with a resin principally comprising a nylon resin. The charging roller 2 has a hardness of 64 degrees (ASKER-C). A prescribed voltage is applied to the core metal 2*b* of the charging roller 2 from a DC power supply 3 which can be superposed with an AC voltage.

The charging roller 2 may be abutted against the photosensitive member 1 at a pressure of 5–500 g/cm$^2$, preferably 10–100 g/cm, and supplied with a DC voltage of 200 V to 1.5 kV in terms of an absolute value.

The AC voltage need not be superposed but, when used, may preferably be adjusted to a peak-to-peak voltage of 500–5000 V and a frequency of 50–3000 Hz.

On the charging roller 2, a portion of the toner or external additive to the toner having slipped by a cleaning blade 9 is liable to be deposited and accumulated, thus resulting in charging irregularity and fog. Accordingly, the charging roller 2 may preferably be equipped with a cleaning mechanism 2*c* which contacts the charging roller 2 at a penetration of preferably at least 0.5 mm only in operation thereof.

The photosensitive drum 1 after the transfer of a toner image is generally cleaned by a cleaning member such as a cleaning blade or roller to remove the residual toner or other dirt, thus resulting in a clean surface to be again subjected to image formation thereon.

Such a cleaning operation may be performed in parallel and simultaneously with the charging, developing and/or transfer operation in electrophotography.

The apparatus further includes a transfer roller 6 which basically comprises an electroconductive elastomer layer 6*a* surfacing a core metal 6*b*. The transfer roller 6 is pressed against the photosensitive member 1 at a certain pressing force and rotated at a peripheral speed which is equal to or different from that of the photosensitive member. A transfer-receiving material 8 is conveyed between the photosensitive member 1 and the transfer roller 6 and simultaneously therewith the transfer roller 6 is supplied with a bias voltage of a polarity opposite to that of the toner from a transfer bias voltage supply 7, whereby the toner image on the photosensitive member is transferred onto the surface of the transfer-receiving material.

In this embodiment, the transfer roller 6 has an outer diameter of 16 mm, and the electroconductive elastomer layer 6*a* comprises foamed ethylene-propylene-diene terpolymer (EPDM). The transfer roller 6 has a hardness of 30 degrees (ASKER-C). The transfer roller 6 may preferably be abutted against the photosensitive member 1 at a pressure of at least 0.5 g/cm, more preferably 3–100 g/cm, in terms of a linear pressure [g/cm] (=a total force applied to the transfer roller [g]/length of abutment [cm]).

The transfer roller 6 may be supplied with a DC voltage of 3.5–7.0 KV in terms of an absolute value.

On the transfer roller 6, a portion of the toner and toner additive scattered from the developing device to the photosensitive member or having slipped by the cleaning blade 9 is liable to be deposited and accumulated, thus resulting in difficulties, such as transfer drop-out, transfer failure or transfer irregularity.

Therefore, it is preferred to apply a voltage of a polarity opposite to that used for transfer to the transfer-receiving member 8 in order to clean the transfer roller. The DC voltage applied for the purpose may preferably be 3.5–7 kV in terms of an absolute value.

The transfer roller 6 may further preferably be equipped with a cleaning mechanism 6*c*.

Then, the transfer-receiving material 8 carrying a toner image is conveyed to a fixing device 11 which basically comprises a heating roller 11*a* enclosing a halogen heater and an elastomeric pressure roller 11*b* pressed against the heating roller 11*a*. Being passed between the rollers 11*a* and 11*b*, the toner image is fixed onto the transfer-receiving material and is outputted as an image product.

More specifically, referring to FIG. 2, the heating roller 11*a* of the heating device comprises a core metal 14 within which a heater 12 is enclosed, and the core metal 14 is surfaced with a resin layer 13. The pressure roller 11*b* comprises a core metal 16 surfaced with an elastomer layer 15.

In the image forming method according to the present invention, it is preferred to minimize the heat capacity of the heating roller 11*a* so as to shorten the waiting time, and the core metal 14 of the heating roller 11*a* may preferably be formed in a thickness of at most 1 mm. The core metal 14 comprises any metal or alloy as far as appropriate strength and stability are ensured but may preferably comprise carbon steel.

The heating roller 11*a* may preferably be coated with a layer 13 of a resin showing good releasability, examples of which may include fluorine-containing resin, silicone resin and amide resin.

The fixing roller may preferably be equipped with a cleaning mechanism, such as a cleaning web or a cleaning pad, of which a cleaning web 11*c* as shown is preferred.

The image forming method according to the present invention may suitably be applied in a system wherein a transfer-receiving material is passed between the rollers 11*a* and 11*b* at a speed (process speed) of at least 150 mm/sec (corresponding to a feed rate of 22.5 sheets of A4 vertical size/min.).

In this embodiment, the surface of the photosensitive member 1 is cleaned with a cleaning mechanism 9 provided with a cleaning blade pressed in a counter direction against the photosensitive member to remove the dirt such as residual toner after the transfer, and is charged-removed by a discharging exposure device 10 to be subjected to repetitive image formation.

Hereinbelow, the present invention will be described more specifically based on Examples which however should not be construed to limit the scope of the invention in any way. In the following description, "part(s)" used to describe a formulation are all by weight.

Synthesis Example 1

A four-necked flask (polymerization vessel) equipped with a nitrogen-introducing pipe, a condenser, a stirrer and a thermometer was charged with 200 parts of deionized water, 80 parts of styrene, 20 parts of n-butyl acrylate and 0.40 part of tetra-functional 1,4-bis(t-butylperoxycarbonyl)cyclohexane (HTP) as a poly-functional polymerization initiator, and the content was subjected to 25 hours of suspension polymerization at 90° C. Thereafter, the product was cooled, washed with water and dried to obtain a high-molecular weight polymer, which is referred to as binder resin A and provided a molecular weight distribution by GPC showing a peak (P2) at a molecular weight of $5.1\times10^5$.

Then, the above polymerization vessel was charged with 800 parts of xylene and heated under nitrogen stream and stirring to 140° C. At the temperature, a mixture of 84 parts of styrene, 16 parts of butyl acrylate, 0.9 part of di-t-butyl peroxide (DTBP, half life=1.6 hours at 140° C.) as a polymerization initiator B, and 0.2 part of p-methane hydroperoxide (half-life=5.0 hours at 140° C.), was added dropwise in two hours by using a continuous dropping device, followed by 4 hours of polymerization to obtain a solution of a low-molecular weight polymer (binder resin B) which provided a molecular weight distribution by GPC showing a peak (P1) at a molecular weight of $1.0\times10^4$.

Into the above polymer solution (containing 70 parts of the binder resin B), 30 parts of binder resin A and 4 parts of low-molecular weight polypropylene (weight-average molecular weight (Mw)=about $10^4$) were dissolved and mixed in 4 hours under sufficient stirring at 100° C., followed by removal of the solvent by vacuum distillation (about 20 mmHg, about 40° C., for 24 hours) and 1 hour of heating at 80° C. under vacuum (about 20 mmHg), to obtain toner binder resin I.

Comparative Synthesis Example 1.

The same polymerization vessel as used in Synthesis Example 1 was charged with 800 parts of xylene and heated under nitrogen stream and stirring to 140° C. At the temperature, a mixture of 84 parts of styrene, 16 parts of butyl acrylate and 1.0 part of di-t-butyl peroxide (DTBP) as a polymerization initiator was added dropwise in 2 hours by using a continuous dropping device, followed by 4 hours of polymerization to obtain a solution of a low-molecular weight polymer (binder resin C) which provided a molecular weight distribution by GPC showing a peak (P1) at a molecular weight of $1.0\times10^4$.

With the above polymer solution, (containing 70 parts of the binder resin C), 30 parts of the binder resin A and 4 parts of the low-molecular weight polypropylene were mixed in the same manner as in Synthesis Example 1 to obtain a toner binder resin II.

The toner binder resin II was further treated under vacuum at 80° C. for 2 hours to obtain a toner binder resin III.

Comparative Synthesis Example 2

A binder resin E was prepared in the same manner as in Comparative Example 1 except that the amount of di-t-butyl peroxide (DTBP, polymerization initiator) was increased to 1.5 parts. The binder resin E showed a peak (P1) at $0.9\times10^4$. In the same manner as in Synthesis Example 1, 30 parts of the binder resin A and 4 parts of the low-molecular weight polypropylene were mixed with the polymer solution containing 70 parts of the binder resin E, followed by removal of the solvent to obtain a toner binder resin IV.

Comparative Synthesis Example 3

A binder resin F was prepared through polymerization in the same manner as in preparation of the binder resin A in Synthesis Example 1 except that the polymerization initiator was changed to 0.2 part of 2,2'-azobis(2,4-dimethylvaleronitrile) and the suspension polymerization was performed for 9 hours at 80° C. The binder resin F provided a molecular weight distribution by GPC showing a peak (P2) at a molecular weight of $2.5\times10^5$.

Then, a solution of the binder resin B was prepared in the same manner as in Synthesis Example 1, and the solution containing 70 parts of the binder resin B was mixed with 30 parts of the binder resin F and 4 parts of the low-molecular weight polypropylene and treated under vacuum in a similar manner to obtain a toner binder resin V.

Synthesis Example 2

A binder resin G was prepared through polymerization in the same manner as in preparation of the binder resin A in Synthesis Example 1 except that the polymerization initiator was changed to 0.4 part of tris(t-butylperoxy)triazine and the suspension polymerization was performed for 8 hours at 80° C. The binder resin G provided a molecular weight distribution by GPC showing a peak (P2) at a molecular weight of $6.0\times10^5$.

Then, a binder resin H was prepared through polymerization in the same manner as in preparation of the binder resin B in Synthesis Example 1 except that a mixture of 85 parts of styrene, 15 parts of butyl acrylate, 4.0 parts of DTBP (polymerization initiator B) and 1.0 part of 2,5-dimethylhexane 2,5-dihydroperoxide (half-life at 140° C.=30 hours, polymerization initiator A) was added into 800 parts of xylene in 2 hours, followed by 8 hours of polymerization. The binder resin H showed a peak (P1) at a molecular weight of $0.4\times10^4$.

Then, similarly as in Synthesis Example 1, 30 parts of the binder resin G and 4 parts of the low-molecular weight polypropylene were mixed with the polymer solution containing 70 parts of the binder resin H, followed by removal of the solvent to obtain a toner binder resin VI.

Synthesis Example 3

A four-necked flask (polymerization vessel) equipped with a nitrogen-introducing pipe, a condenser, a stirrer and a thermometer was charged with 200 parts of deionized water, 80 parts of styrene, 20 parts of n-butyl acrylate and 0.13 part of 2,2-bis(4,4-tert-butylperoxycyclohexyl)propane as a poly-functional polymerization initiator, and the content was subjected to 25 hours of suspension polymerization at 90° C. Thereafter, the product was cooled, washed with water and dried to obtain a high-molecular weight polymer, which is referred to as binder resin A and provided a molecular weight distribution by GPC showing a peak (P2) at a molecular weight of $8.0\times10^5$.

Then, similarly as in Synthesis Example 1, a solution containing the binder resin B was prepared, and 30 parts of the binder resin J and 4 parts of the low-molecular weight polypropylene were mixed with the polymer solution containing 70 parts of the binder resin H, followed by removal of the solvent to obtain a toner binder resin VII.

Comparative Synthesis Example 4

| | |
|---|---|
| Styrene | 76 part(s) |
| Butyl acrylate | 23 part(s) |
| Divinylbenzene | 0.3 part(s) |
| Di-tert-butyl peroxide | 0.8 part(s) |

The above ingredients were added dropwise in 4 hours to 200 parts of xylene heated to the reflux temperature, followed by 4 hours of polymerization under reflux of the xylene (138°-144° C.) to complete the polymerization and removal of the xylene by raising the temperature up to 200° C. under vacuum, thereby to obtain a resin VIII.

Comparative Synthesis Example 5

| | |
|---|---|
| Styrene | 73 part(s) |
| Butyl acrylate | 24 part(s) |
| Di-tert-butyl peroxide | 0.8 part(s) |

The above ingredients were added dropwise in 2 hours to 200 parts of xylene heated 80°-90° C., followed by 6 hours of polymerization under reflux of the xylene to complete the polymerization and removal of the xylene by raising the temperature up to 200° C. under vacuum, thereby to obtain a resin IX.

EXAMPLE 1

| | |
|---|---|
| Binder resin VII | 100 part(s) |
| Triiron tetroxide (average particle size = 0.2 μm) | 90 part(s) |
| Nigrosine | 2 part(s) |

The above ingredients were sufficiently blended in a blender and melt-kneaded through a twin-screw kneading extruder set at 80° C. The kneaded product was cooled, coarsely crushed by a cutter mill, finely pulverized by a pulverizer using jet air and classified by a multi-division classifier utilizing the Coanda effect, to obtain black fine powder (magnetic toner) having a weight-average particle size of 8.5 μm.

100 parts of the resultant black fine powder (magnetic toner) and 0.6 part of positively chargeable hydrophobic dry-process silica were blended in a Henschel mixer to obtain a positively chargeable magnetic toner carrying the silica powder attached to the toner particles.

0.2 g of the thus-obtained magnetic toner was dissolved in 20 ml of THF (tetrahydrofuran) and the solution was filtered to remove the magnetic material and other insoluble matter. Substantially no styrene resin remained insoluble in THF. The solution was subjected to GPC (gel permeation chromatography) measurement. The resultant GPC chromatogram is shown in FIG. 2 and the results are summarized in Table 1 appearing hereinafter.

A succession image formation test of 20000 sheets of A4-size plain paper were performed by using an image forming apparatus shown in FIG. 1 under the following set of conditions:

[Charging roller]
- abutting pressure against the photosensitive member: 50 g/cm,
- applied voltage: −1400 volts (DC)

[Transfer roller]
- abutting pressure against the photosensitive member: 20 g/cm
- applied voltage: −6000 volts (DC)
- peripheral speed difference with the photosensitive member: 0

Abutting pressure of the cleaning blade: 20 g/cm

[Developing bias voltage]
- AC: Vpp=1300 volts, Vf=1800 Hz
- DC: Vdc=−210 volts

Distance between the photosensitive member and the developer-carrying member: 300 μm Hot fixing roller: comprising a 0.8 mm-thick core metal cylinder of carbon steel coated with a PTFE layer and containing two halogen lamps inside thereof, and the external surface thereof being regulated to a prescribed temperature (approximately 160°-200° C.).

Pressure roller: comprising a 1 mm-thick core metal cylinder of carbon steel coated with a 2 mm-thick silicone rubber layer.

Process speed: 200 mm/sec.

As a result, even after copying of the 20000 sheets, images having excellent image qualities and high densities were obtained.

Table 2 appearing hereinafter summarizes the results of evaluation of image density, fog, filming, dirt on the transfer roller, amount of silica accumulated on the stay of the developing device, residual monomer content in the toner and odor at the time of fixing. The odor at the time of fixing was evaluated as a relative test by 3 panelists.

Then, the above image. forming apparatus was remodeled by removing the fixing device and used to form unfixed images on plain paper sheets. On the other hand, the removed fixing device was used as an external fixing device of a variable temperature-type to effect a fixing test and an offset test of the unfixed images.

The external fixing device was adjusted to have a nip of 4.0 mm and a process speed of 200 mm/sec. The fixing test was performed at various controlled temperatures in the temperature range of 100°-250° C. at a temperature increment of 5° C. so as to fix the unfixed images. The resultant fixed images were rubbed with a lens cleaning paper ("Dasper", mfd. by Ozu Paper Co., Ltd.) under a load of 50 g/cm$^2$, and the lowermost temperature giving a decrease in image density after the rubbing of at most 2% was taken as a fixing initiation temperature. As a result, the fixing initiation temperature was as low as 170° C. and the offset initiation temperature was as high as 250° C., thus showing an excellent anti-offset characteristic.

Then, the image forming apparatus was used to continuously form 100 sheets of A3-size images and then left standing for 30 sec., followed by forming 5 sheets of A3-size solid white images. From the degree of soiling or dirt on both sides of the copied sheets, the offset toner flowout characteristic was evaluated whereby no dirt was observed on either side, thus showing excellent offset toner flowout-preventing characteristic.

The above magnetic toner was left standing for two weeks at 50° C. in a drier to evaluate the anti-blocking characteristic, whereby absolutely no problem was conceived in this regard.

These results are summarized in Table 3.

EXAMPLE 2

A toner was prepared and evaluated in the same manner as in Example 1 except that the binder resin I was used instead of the binder resin VII.

The results are shown in Tables 1-3.

EXAMPLE 3

A toner was prepared and evaluated in the same manner as in Example 1 except that the binder resin VI was used instead of the binder resin VII.

The results are shown in Tables 1-3.

EXAMPLE 4

The toner prepared in Example 1 was evaluated by image formation in a commercially available copying machine ("NP-2020", mfd. by Canon K.K.).

From the outset, excellent images having a high image density of 1.40 were obtained. Even after $20\times10^4$ sheets of successive copying, excellent images showing an image density of 1.37 and free from fog or filming were obtained. Little odor was evolved.

Comparative Examples 1–6

Toners were prepared and evaluated in the same manner as in Example 1 except that the binder resin VII was replaced by the binder resin II, III, IV, V, VIII and IX, respectively.

The results are shown in Tables 1–3.

TABLE 1

| | Toner resin | GPC peak of material resin ($\times10^4$) P1 | P2 | Proportion of M.W. ≦ 3000 in material resin (%) | GPC peak of toner resin ($\times10^4$) P1 | P2 | Proportion of M.W. ≦ 3000 in toner resin (%) |
|---|---|---|---|---|---|---|---|
| Ex. | | | | | | | |
| 1 | VII | 1.0 | 80 | 10.0 | 1.0 | 56 | 9.9 |
| 2 | I | 1.0 | 51 | 10.7 | 1.0 | 32 | 12.9 |
| 3 | VI | 0.40 | 60 | 12.8 | 0.45 | 38 | 13.7 |
| Comp. Ex. | | | | | | | |
| 1 | II | 1.0 | 51 | 13.2 | 0.9 | 32 | 14.5 |
| 2 | III | 1.0 | 51 | 13.2 | 0.9 | 30 | 14.5 |
| 3 | IV | 0.9 | 51 | 17.8 | 0.9 | 31 | 18.6 |
| 4 | V | 1.0 | 25 | 10.7 | 0.9 | 17 | 13.3 |
| 5 | VIII | 5.0 | — | 12.3 | 7.0 | 120 | 12.5 |
| 6 | IX | 8.0 | — | 12.0 | 7.8 | — | 12.4 |

TABLE 2

| | Initial images | | Images after $2\times10^4$ sheets | | | Dirt on transfer | Silica accumulation | Residual monomer (ppm) | | | |
|---|---|---|---|---|---|---|---|---|---|---|---|
| | Density | Fog | Density | Fog | Filming | roller | on stay | Styrene | Acrylate | Benzaldehyde | Odor |
| Ex. | | | | | | | | | | | |
| 1 | 1.42 | ○ | 1.42 | ○ | ○ | ○ | ○ | 19 | 10> | — | ○ |
| 2 | 1.42 | ○ | 1.41 | ○ | ○ | ○ | ○ | 23 | 10> | — | ○ |
| 3 | 1.40 | ○ | 1.40 | ○ | ○ | ○ | ○Δ | 54 | 10> | — | ○ |
| Comp. Ex. | | | | | | | | | | | |
| 1 | 1.33 | ○Δ | 1.25 | Δ | Δ | Δ | Δ | 350 | 50 | 20 | Δx |
| 2 | 1.34 | ○Δ | 1.27 | ○Δ | ○Δ | ○Δ | Δ | 160 | 20 | 10 | Δ |
| 3 | 1.27 | Δ | 1.19 | Δx | Δx | Δ | Δ | 130 | 25 | 10 | Δ |
| 4 | 1.40 | ○ | 1.38 | ○ | ○ | ○ | ○ | 25 | 10> | — | ○ |
| 5 | 1.32 | ○Δ | 1.35 | ○Δ | ○ | Δ | Δ | 230 | 40 | 20 | Δx |
| 6 | 1.33 | ○Δ | 1.37 | ○Δ | x | Δ | Δ | 420 | 60 | 20 | Δx |

Evaluation standards of respective items in Table 2 are as follows:

Fog
- ○: no fog
- ○Δ: Slight fog
- Δ: Conspicuous fog
- Δ×: Conspicuous and severe fog Filming
- ○: Not occurred
- Δ: Slightly occurred
- ×: Occurred Dirt on transfer roller
- ○: None or very slight
- ○Δ: A little dirt
- Δ: Substantial dirt Silica accumulation on stay (of developing device)
- ○: Very little
- ○Δ: Little
- Δ: Relatively much Odor (at the time of copying)
- ○: Good
- Δ: Slight odor
- Δ×: Odor Residual monomer
- —○: Not detected
- 10>: Less than 10 ppm

TABLE 3

| | Fixing initiation temp. (°C.) | Offset initiation temp. (°C.) | Image dirt by offset toner flowout | Blocking |
|---|---|---|---|---|
| Ex. | | | | |
| 1 | 170 | 250 | ○ | ○ |
| 2 | 170 | 250 | Δ | ○ |
| 3 | 160 | 240 | ○Δ | ○Δ |
| Comp. Ex. | | | | |
| 1 | 170 | 250 | Δ | ○Δ |
| 2 | 170 | 250 | Δ | ○ |
| 3 | 160 | 230 | Δ | Δx |
| 4 | 170 | 230 | Δx | ○ |
| 5 | 200 | 250 | ○ | ○ |
| 6 | 180 | 200 | Δx | Δ |

Evaluation standards of items in Table 3 are as follows:

Image dirt due to offset toner flowout
- ○: Substantially no
- ○Δ: Slight dirt
- Δ: Some dirt
- Δ×: Substantial dirt Blocking
- ○: Utterly no ○Δ: Substantially no ○Δ: Some Δ×: Substantial agglomeration As described above, the toner according to the present invention containing a specific binder resin and only little residual monomer show excellent low-temperature fixability as well as excellent anti-offset characteristic. Further, when used in an image forming method adopting a hot roller fixation system using a hot roller having a core metal thickness of at most 1 mm, the toner realizes shorter waiting time and higher speed electrophotographic process.

Further, the toner according to the present invention contains little volatile matter such as residual monomer, thus evolving little odor at the time of copying.

Further, by using the above image forming method utilizing the toner, it is possible to provide an image forming apparatus evolving little toner odor. Further, the toner is less sticky onto the charging member and photosensitive member and provides images with excellent image qualities and high image densities and free from fog for a long period.

What is claimed is:

1. A toner for developing an electrostatic image, comprising a binder resin, and a magnetic material and/or a colorant, wherein the binder resin (a) comprises a styrene resin polymerized in the presence of a poly-functional polymerization initiator, (b) provides a molecular weight distribution on a GPC chromatogram showing a maximum (P1) in a molecular weight range of $3.5\times10^3$–$5\times10^4$ and a maximum (P2) or shoulder in a molecular weight range of at least $1\times10^5$, and (c) contains 15 wt. % or less of a resin component in a molecular weight range of at most $3\times10^3$, and the toner contains at most 100 ppm of styrene and benzaldehyde.

2. The toner according to claim 1, wherein the poly-functional polymerization initiator has three or more radical-generating functional groups.

3. The toner according to claim 1, wherein the poly-functional polymerization initiator has four or more radical-generating functional groups.

4. The toner according to claim 1, wherein the poly-functional polymerization initiator is a radical polymerization initiator selected from the group consisting of 1,4-bis(t-butylperoxycarbonyl)cyclohexane, 2,2-bis(4,4-di-t-butylperoxycyclohexyl)propane, and tris(t-butylperoxy)triazine.

5. The toner according to claim 1, wherein the binder resin contains 5–50 wt. % of a component in a molecular weight range of at least $1\times10^5$.

6. The toner according to claim 1, wherein the binder resin contains 10–50 wt. % of a component in a molecular weight range of at least $1\times10^5$.

7. The toner according to claim 1, wherein the binder resin provides a maximum (P1) in a molecular weight range of $5\times10^3$–$5\times10^4$.

8. The toner according to claim 1, wherein the binder resin contains at most 13 wt. % of the resin component in the molecular weight range of at most $3\times10^3$.

9. The toner according to claim 1, wherein the binder resin contains at most 10 wt. % of the resin component in the molecular weight range of at most $3\times10^3$.

10. The toner according to claim 1, wherein the binder resin contains a resin component obtained through polymerization in the presence of at least two polymerization initiators including a polymerization initiator A having a longer half-life $\tau_A$ and a polymerization initiator B having a shorter half-life $\tau_B$ providing a ratio $\tau_A/\tau_B$ of at least 1.5.

11. The toner according to claim 1, wherein the binder resin comprises a mixture of a high-molecular weight styrene resin and a low-molecular weight vinyl resin.

12. The toner according to claim 11, wherein the high-molecular weight styrene resin has been obtained through polymerization in the presence of a poly-functional polymerization initiator.

13. The toner according to claim 11, wherein the high-molecular weight styrene resin comprises a styrene-acrylate copolymer obtained through polymerization in the presence of a poly-functional polymerization initiator.

14. The toner according to claim 11, wherein the high-molecular weight styrene resin comprises a styrene-methacrylate copolymer obtained through polymerization in the presence of a poly-functional polymerization initiator.

15. The toner according to claim 11, wherein the low-molecular weight vinyl resin comprises a styrene resin.

16. The toner according to claim 11, wherein the binder resin comprises 10–70 wt. parts of the high-molecular weight styrene resin and 90–30 wt. parts of the low-molecular weight vinyl resin.

17. The toner according to claim 11, wherein the binder resin comprises 20–60 wt. parts of the high-molecular weight styrene resin and 80–40 wt. parts of the low-molecular weight vinyl resin.

18. The toner according to claim 1, wherein the binder resin comprises a mixture of a high-molecular weight styrene resin providing a maximum in the molecular weight range of at least $1\times10^5$ and obtained through polymerization in the presence of a poly-functional polymerization initiator, and a low-molecular weight vinyl resin providing a maximum in the molecular weight range of $3.5\times10^3$–$5\times10^4$ and obtained through polymerization in the presence of at least two polymerization initiators including a polymerization initiator A having a longer half-life $\tau_A$ and a polymerization initiator B having a shorter half-life $\tau_B$ providing a ratio $\tau_A/\tau_B$ of at least 1.5.

19. The toner according to claim 18, wherein the high-molecular weight styrene resin has been obtained through polymerization in the presence of a poly-functional polymerization initiator in an amount of 0.01–5 wt. % of a polymerizable monomer providing the high-molecular weight styrene resin.

20. The toner according to claim 18, wherein the high-molecular weight styrene resin has been obtained through polymerization in the presence of a poly-functional polymerization initiator in an amount of 0.05–3 wt. % of a polymerizable monomer providing the high-molecular weight styrene resin.

21. The toner according to claim 18, wherein the low-molecular weight vinyl resin has been obtained through polymerization at a polymerization temperature of 75°–145° C. in the presence of a polymerization initiator B having a half-life $\tau_B$ at least 0.1 hour at the polymerization temperature.

22. The toner according to claim 18, wherein the low-molecular weight vinyl resin has been obtained through polymerization at a polymerization temperature of 75°–145° C. in the presence of a polymerization initiator B having a half-life $\tau_B$ 0.5–10 hours at the polymerization temperature.

23. The toner according to claim 10, wherein the ratio $\tau_A/\tau_B$ at the polymerization temperature is 2 to 5000.

24. The toner according to claim 18, wherein the low-molecular weight vinyl resin has been obtained through polymerization at a polymerization temperature of 75°–145° C. in the presence of a polymerization initiator B having a half-life $\tau_B$ of 0.5–3 hours at the polymerization temperature, and a polymerization initiator A having a half-life $\tau_A$ of 2–60 hours at the polymerization initiator.

25. The toner according to claim 24, wherein the ratio $\tau_A/\tau_B$ is 2 to 500.

26. The toner according to claim 18, wherein the low-molecular weight vinyl resin has been obtained through polymerization in the presence of the polymerization initiators A and B in a total amount of 0.1–5 wt. parts per 100 wt. parts of a polymerizable monomer providing the low-molecular weight vinyl resin.

27. The toner according to claim 26, wherein the polymerization initiators A and B are used in a weight ratio (A/B) of 0.01–100.

28. The toner according to claim 26, wherein the polymerization initiators A and B are used in a weight ratio (A/B) of 0.1–10.

29. The toner according to claim 1, wherein the benzaldehyde content in the toner is at most 10 ppm.

30. The toner according to claim 1, wherein the styrene content in the toner is at most 50 ppm.

31. The toner according to claim 1, further containing 0.5–10 wt. parts of a waxy substance per 100 wt. parts of the binder resin.

32. An image forming method, comprising:

charging an electrostatic latent image-bearing member by abutting a charging member supplied with a voltage to the electrostatic latent image-bearing member;

exposing the charged electrostatic image-bearing member to light to form an electrostatic latent image thereon;

developing the electrostatic latent image with a toner to form a toner image thereon, the toner comprising a binder resin, and a magnetic material and/or a colorant, wherein the binder resin (a) comprises a styrene resin polymerized in the presence of a poly-functional polymerization initiator, (b) provides a molecular weight distribution on a GPC chromatogram showing a maximum (P1) in a molecular weight range of $3.5\times10^3$–$5\times10^4$ and a maximum (P2) or shoulder in a molecular weight range of at least $1\times10^5$, and (c) contains 15 wt. % or less of a resin component in a molecular weight range of at most $3\times10^3$, and the toner contains at most 100 ppm of styrene and benzaldehyde;

transferring the toner image onto a transfer-receiving material while pressing the transfer-receiving material by a transfer member supplied with a voltage against the toner image, and fixing the toner image transferred to the transfer-receiving material onto the transfer-receiving material by a hot roller having a core metal thickness of at most 1 mm.

33. the image forming method according to claim 32, wherein the poly-functional polymerization initiator has three or more radical-generating functional groups.

34. The image forming method according to claim 32, wherein the poly-functional polymerization initiator has four or more radical-generating functional groups.

35. The image forming method according to claim 32, wherein the poly-functional polymerization initiator is a radical polymerization initiator selected from the group consisting of 1,4-bis(t-butylperoxycarbonyl)cyclohexane, 2,2-bis(4,4-di-t-butylperoxycyclohexyl)propane and tris(t-butylperoxy)triazine.

36. The image forming method according to claim 32, wherein the binder resin contains 5–50 wt. % of a component in a molecular weight range of at least $1\times10^5$.

37. The image forming method according to claim 32, wherein the binder resin contains 10–50 wt. % of a component in a molecular weight range of at least $1\times10^5$.

38. The image forming method according to claim 32, wherein the binder resin provides a maximum (P1) in a molecular weight range of $5\times10^3$–$5\times10^4$.

39. The image forming method according to claim 32, wherein the binder resin contains at most 13 wt. % of the resin component in the molecular weight range of at most $3\times10^3$.

40. The image forming method according to claim 32, wherein the binder resin contains at most 10 wt. % of the resin component in the molecular weight range of at most $3\times10^3$.

41. The image forming method according to claim 32, wherein the binder resin contains a resin component obtained through polymerization in the presence of at least two polymerization initiators including a polymerization initiator A having a longer half-life $t_A$ and a polymerization initiator B having a shorter half-life $t_B$ providing a ratio $t_A/t_B$ of at least 1.5.

42. The image forming method according to claim 32, wherein the binder resin comprises a mixture of a high-molecular weight styrene resin and a low-molecular weight vinyl resin.

43. The image forming method according to claim 42, wherein the high-molecular weight styrene resin has been obtained through polymerization in the presence of a poly-functional polymerization initiator.

44. The image forming method according to claim 42, wherein the high-molecular weight styrene resin comprises a styrene-acrylate copolymer obtained through polymerization in the presence of a poly-functional polymerization initiator.

45. The image forming method according to claim 42, wherein the high-molecular weight styrene resin comprises a styrene-methacrylate copolymer obtained through polymerization in the presence of a poly-functional polymerization initiator.

46. The image forming method according to claim 42, wherein the low-molecular weight vinyl resin comprises a styrene resin.

47. The image forming method according to claim 42, wherein the binder resin comprises 10–70 wt. parts of the high-molecular weight styrene resin and 90–30 wt. parts of the low-molecular weight vinyl resin.

48. The image forming method according to claim 42, wherein the binder resin comprises 20–60 wt. parts of the high-molecular weight styrene resin and 80–40 wt. parts of the low-molecular weight vinyl resin.

49. The image forming method according to claim 32, wherein the binder resin comprises a mixture of a high-molecular weight styrene resin providing a maximum in the molecular weight range of at least $1\times10^5$ and obtained through polymerization in the presence of a poly-functional polymerization initiator and a low-molecular weight vinyl resin providing a maximum in the molecular weight range of $3.5\times10^3$–$5\times10^4$ and obtained through polymerization in the presence of at least two polymerization initiators including a polymerization initiator A having a longer half-life $t_A$ and a polymerization initiator B having a shorter half-life $t_B$ providing a ratio $t_A/t_B$ of at least 1.5.

50. The image forming method according to claim 49, wherein the high-molecular weight styrene resin has been obtained through polymerization in the presence of a poly-functional polymerization initiator in an amount of 0.01–5 wt. % of a polymerizable monomer providing the high-molecular weight styrene resin.

51. The image forming method according to claim 49, wherein the high-molecular weight styrene resin has been obtained through polymerization in the presence of a poly-functional polymerization initiator in an amount of 0.05–3 wt. % of a polymerizable monomer providing the high-molecular weight styrene resin.

52. The image forming method according to claim 49, wherein the low-molecular weight vinyl resin has been obtained through polymerization at a polymerization temperature of 75°–145° C. in the presence of a polymerization initiator B having a half-life $t_B$ at least 0.1 hour at the polymerization temperature.

53. The image forming method according to claim 49, wherein the low-molecular weight vinyl resin has been obtained through polymerization at a polymerization temperature of 75°–145° C. in the presence of a polymerization initiator B having a half-life $t_B$ 0.5–10 hours at the polymerization temperature.

54. The image forming method according to claim 49, wherein the ratio $t_A/t_B$ at the polymerization temperature is 2 to 5,000.

55. The image forming method according to claim 49, wherein the low-molecular weight vinyl resin has been obtained through polymerization at a polymerization temperature of 75°–145° C. in the presence of a polymerization initiator B having a half-life $t_B$ of 0.5–3 hours at the polymerization temperature and a polymerization initiator A having a half-life $t_A$ of 2–60 hours at the polymerization temperature.

56. The image forming method according to claim 55, wherein the ratio $t_A/t_B$ is 2 to 500.

57. The image forming method according to claim 49, wherein the low-molecular weight vinyl resin has been obtained through polymerization in the presence of the polymerization initiators A and B in a total amount of 0.1–5 wt. parts per 100 wt. parts of a polymerizable monomer providing the low-molecular weight vinyl resin.

58. The image forming method according to claim 57, wherein the polymerization initiators A and B are used in a weight ratio (A/B) of 0.01–100.

59. The image forming method according to claim 57, wherein the polymerization initiators A and B are used in a weight ratio (A/B) of 0.01–10.

60. The image forming method according to claim 32, wherein the benzaldehyde content in the toner is at most 10 ppm.

61. The image forming method according to claim 32, wherein the styrene content in the toner is at most 50 ppm.

62. The image forming method according to claim 32, wherein the toner further contains 0.5–10 wt. parts of a waxy substance per 100 wt. parts of the binder resin.

63. The image forming method according to claim 32, wherein the charging member is a contact charging means.

64. The image forming method according to claim 63, wherein the charging member is supplied with DC voltage.

65. The image forming method according to claim 63, wherein the charging member is supplied with AC voltage.

66. The image forming method according to claim 63, wherein the charging member is supplied with DC voltage and AC voltage.

67. The image forming method according to claim 63, wherein the contact charging means comprises a charging roller.

68. The image forming method according to claim 67, wherein the charging roller is supplied with DC voltage.

69. The image forming method according to claim 67, wherein the charging roller is supplied with AC voltage.

70. The image forming method according to claim 67, wherein the charging roller is supplied with DC voltage and AC voltage.

71. The image forming method according to claim 32, wherein the transfer member comprises a transfer roller.

72. The image forming method according to claim 32, wherein the transfer member comprises a rotatable cylinder.

73. The image forming method according to claim 32, wherein the transfer member comprises an endless belt.

74. The image forming method according to claim 32, wherein the transfer member is supplied with DC voltage.

75. The image forming method according to claim 71, wherein the transfer roller is supplied with DC voltage.

76. The image forming method according to claim 32, wherein the charging member is a contact charging means and the transfer member comprises a transfer roller.

77. The image forming method according to claim 76, wherein the contact charging means comprises a charging roller.

* * * * *

UNITED STATES PATENT AND TRADEMARK OFFICE

CERTIFICATE OF CORRECTION

PATENT NO. : 5,447,813

DATED : September 5, 1995

INVENTOR : KAZUYOSHI HAGIWARA, ET AL.

It is certified that errors appear in the above-identified patent and that said Letters Patent is hereby corrected as shown below:

ON THE TITLE PAGE:

[56] References Cited

U.S. Patent Documents, insert the following:

--2,297,691 10/1942 Carlson .....95/5
3,666,363 5/1972 Tanaka et al. .....355/17
4,071,361 1/1978 Marushima .....96/14
4,966,829 10/1990 Yasuda et al. .....430/109
5,149,941 9/1992 Hirabayashi et al. .....219/216--;

Foreign Patent Documents, insert the following:

--417812 3/1991 European Pat. Off.
266697 5/1988 European Pat. Off.
331393 9/1989 European Pat. Off.
438181 7/1991 European Pat. Off.
59-46664 3/1984 Japan ....G03G/15/16
63-32182 6/1988 Japan ....G03G/9/08
63-32382 6/1988 Japan ....G03G/13/22--.

DRAWINGS

Sheet 2, Fig. 2, "Ares" should read --Area--.

COLUMN 2

Line 42, "such such" should read --such--; and

Line 55, "apparatus" should read --apparatus; an--.

UNITED STATES PATENT AND TRADEMARK OFFICE

CERTIFICATE OF CORRECTION

PATENT NO. : 5,447,813

DATED : September 5, 1995

INVENTOR : KAZUYOSHI HAGIWARA, ET AL.

It is certified that errors appear in the above-identified patent and that said Letters Patent is hereby corrected as shown below:

COLUMN 3

Line 6, "photosensitive mim-" should read --photosensitive mem- --.

COLUMN 4

Line 50, "$3x10^3$ and" should read --$3x10^3$, and--.

COLUMN 6

Line 35, "$5x10^3 5x10^4$." should read --$5x10^3$-$5x10^4$.--; and

Line 51, "$5x10^4$" should read --$5x10^4$,--.

COLUMN 7

Line 20, "$3.5x10^3 5x10^4$" should read --$3.5x10^3$-$5x10^4$--; and

Line 40, "$3x10^3$ As" should read --$3x10^3$. As--; and "result" should read --result,--.

COLUMN 9

Line 24, "octanoyl peroxide," should be deleted;

Line 27, "parachlorobezoyl" should read --parachlorobenzoyl--; and

Line 53, "initiator" should read --initiators--.

UNITED STATES PATENT AND TRADEMARK OFFICE

CERTIFICATE OF CORRECTION

PATENT NO. : 5,447,813

DATED : September 5, 1995

INVENTOR : KAZUYOSHI HAGIWARA, ET AL.

It is certified that errors appear in the above-identified patent and that said Letters Patent is hereby corrected as shown below:

COLUMN 12

Line 49, "complexes" should read --complexes,--;

Line 58, "etc,," should read --etc.,--;

Line 59, "quartunary" should read --quatenary--; and

Line 62, "gous" should read --gues--.

COLUMN 13

Line 6, "quartunary" should read --quatenary--.

COLUMN 16

Line 18, "FIG. 2," should read --FIG. 1,--.

COLUMN 22

Line 8, "—°:" should read -- —:--.

COLUMN 23

Line 6, "show" should read --shows--.

COLUMN 25

Line 13, "initiator." should read --temperature.--.

COLUMN 26

Line 1, "the" should read --The--.

UNITED STATES PATENT AND TRADEMARK OFFICE

CERTIFICATE OF CORRECTION

PATENT NO. : 5,447,813

DATED : September 5, 1995

INVENTOR : KAZUYOSHI HAGIWARA, ET AL.

It is certified that errors appear in the above-identified patent and that said Letters Patent is hereby corrected as shown below:

COLUMN 27

Line 37, "half-life $t_B$" should read --half-life $t_B$ of--.

Signed and Sealed this

Twenty-third Day of April, 1996

Bruce Lehman

*Attest:*

BRUCE LEHMAN

*Attesting Officer*

*Commissioner of Patents and Trademarks*